US010961010B2

(12) United States Patent
Clements et al.

(10) Patent No.: US 10,961,010 B2
(45) Date of Patent: Mar. 30, 2021

(54) TRAY WITH ENHANCED RIGIDITY AND CRUSH STRENGTH

(71) Applicant: ConAgra Foods RDM, Inc., Omaha, NE (US)

(72) Inventors: James W. Clements, Russellville, AR (US); Chadd R. Chatterton, Kenosha, WI (US)

(73) Assignee: Conagra Foods RDM, Inc., Omaha, NE (US)

( * ) Notice: Subject to any disclaimer, the term of this patent is extended or adjusted under 35 U.S.C. 154(b) by 229 days.

(21) Appl. No.: 15/558,398

(22) PCT Filed: Mar. 17, 2015

(86) PCT No.: PCT/US2015/020970
§ 371 (c)(1),
(2) Date: Sep. 14, 2017

(87) PCT Pub. No.: WO2016/148699
PCT Pub. Date: Sep. 22, 2016

(65) Prior Publication Data

US 2018/0057202 A1 Mar. 1, 2018

(51) Int. Cl.
*B65D 1/42* (2006.01)
*B65D 1/34* (2006.01)
(Continued)

(52) U.S. Cl.
CPC ..... *B65D 1/42* (2013.01); *A47G 23/06* (2013.01); *B65D 1/34* (2013.01); *B65D 81/343* (2013.01); *B65D 81/3453* (2013.01)

(58) Field of Classification Search
CPC ..... B65D 1/34; B65D 1/42; B65D 81/343; B65D 81/3453; A47G 23/06
(Continued)

(56) References Cited

U.S. PATENT DOCUMENTS 3,130,860 A * 4/1964 Oberkircher ..... B65D 21/0213 206/509
3,420,431 A * 1/1969 Donovan ..... B65D 1/36 206/557
(Continued)

OTHER PUBLICATIONS

Notification of Transmittal of the International Search Report and The Written Opinion of the International Searching Authority—dated Jun. 15, 2015.

*Primary Examiner* — James N Smalley
*Assistant Examiner* — Jennifer Castriotta
(74) *Attorney, Agent, or Firm* — Ryan T. Grace; Advent, LLP

(57) ABSTRACT

The present invention is directed to a tray endowed with an improved rigidity and resistance to deformation and bending. The tray comprises a plurality of primary sidewalls and a plurality of chamfered corners having a corner secondary sidewall integrally formed with and extending from the base, wherein the primary sidewalls and corner secondary sidewalls define a product receiving cavity. The tray further includes a plurality of ribs integrally formed with and extending downwardly from the base, and a plurality of channels positioned between and separating adjacent ribs, wherein each channel is substantially perpendicular to a corner secondary side wall.

22 Claims, 6 Drawing Sheets

(51) Int. Cl.
*A47G 23/06* (2006.01)
*B65D 81/34* (2006.01)

(58) Field of Classification Search
USPC ..... 206/557
See application file for complete search history.

(56) References Cited

U.S. PATENT DOCUMENTS

| | | | | | |
|---|---|---|---|---|---|
| 3,578,204 | A * | 5/1971 | Bloch | B65D 1/34 | 220/671 |
| 3,583,623 | A * | 6/1971 | Golner | B65D 1/34 | 229/406 |
| 3,863,833 | A * | 2/1975 | Swett | A47J 47/02 | 220/4.21 |
| 3,884,383 | A | 5/1975 | Burch et al. | | |
| 4,058,247 | A | 11/1977 | Florian | | |
| D256,308 | S * | 8/1980 | Zimmermann | D11/143 | |
| 4,442,969 | A * | 4/1984 | Holden | B65D 1/34 | 220/608 |
| 4,616,762 | A * | 10/1986 | Alexander | A47J 36/022 | 206/503 |
| 4,834,243 | A * | 5/1989 | Langenbeck | B65B 5/068 | 206/203 |
| 8,895,092 | B1 * | 11/2014 | Field | B65B 25/06 | 206/497 |
| 2010/0258471 | A1 * | 10/2010 | Enriquez | B65D 1/34 | 206/557 |
| 2011/0189355 | A1 * | 8/2011 | Field | B65D 81/2069 | 426/129 |
| 2012/0006842 | A1 | 1/2012 | Overgaag | | |
| 2014/0069937 | A1 | 3/2014 | Melrose | | |
| 2018/0029767 | A1 * | 2/2018 | Chung | D21H 17/29 | |

* cited by examiner

TRAY WITH ENHANCED RIGIDITY AND CRUSH STRENGTH

BACKGROUND OF THE INVENTION

The present invention relates generally to primary packaging and more particularly, to formed packaging trays for containing a product. Specifically, the present invention refers to a formed solid tray for food and non-food products, endowed with improved rigidity and resistance to deformation and bending, by relying on particular tray features and geometries.

It is known to provide packaged, precooked or partially cooked food products, such as soups, stews, and rice, pasta or wheat products that can be reheated in a short time, for example in a microwave or conventional oven. These products are sometimes referred to as "ready-to-heat" or "one-minute" products. When such products are produced, the food product is placed in a rigid tray, whereupon a flexible plastic lidding film is sealed to the top of the tray. The package with the food product contained therein is then inserted into a microwave tunnel for cooking and/or pasteurization/sterilization of the food product to the ready-to-eat state, and during this cooking and/or pasteurization/sterilization process vapor from the food product is produced creating pressure in excess of the ambient atmosphere. These vapors are permitted to exit through an orifice in the lidding film covering the tray or by some other means. When the cooking and/or pasteurization/sterilization process is completed, the orifice is closed and the package is introduced into a cooling tunnel. A partial vacuum is created inside the package automatically as a consequence of cooling. One problem encountered in packages presently on the market is that if the tray is too soft, the package partially collapses when it cools and evacuates, typically causing the sidewalls and/or bottom of the rigid tray to be drawn inwardly towards the center of the package which dramatically changes the appearance of the package. Any deformation of the tray can jeopardize the hermeticity of the seal between the lidding film and tray. This deformation of the tray can also be intensified by the force exerted on the package by the change in shape of the flexible lidding film during cooling. This change in appearance of the package is aesthetically unpleasing and customers generally tend to reject products having an undesirable appearance. Deformation of the tray can be mitigated by some degree by increasing the rigidity of the tray by increasing its thickness. This however adds material and cost for the manufacture of the tray. Accordingly, there is still a need in the art for a formed tray endowed with an improved rigidity and resistance to deformation and bending, where these improvements are achieved by relying on specific tray features and geometries without requiring increased material cost and/or manufacturing costs.

SUMMARY OF THE INVENTION

The present invention is directed to formed trays for packaging a product. The trays comprise a base having an interior surface and an exterior surface, a portion of the interior surface defining a raised product contact surface. The trays further comprise a plurality of primary sidewalls integrally formed with and extending upwardly and slightly outwardly from the base wherein each primary sidewall has an upper portion and a lower portion and a plurality of chamfered corners integrally formed with and extending from the base, each corner has a corner secondary sidewall connecting a pair of primary sidewalls, wherein each corner secondary sidewall has an upper portion and a lower portion such that the base, primary sidewalls and corner secondary sidewalls define a product receiving cavity. The trays still further include a plurality of ribs integrally formed with and extending downwardly from the base, wherein each rib is joined to a primary sidewall and a plurality of channels positioned between and separating adjacent ribs, wherein each channel is substantially perpendicular to a corner secondary sidewall.

BRIEF DESCRIPTION OF THE DRAWINGS

Further features and advantages of the present invention will become apparent from the following detailed description, taken in combination with the appended drawings, in which.

DETAILED DESCRIPTION OF THE INVENTION

Figure 1:
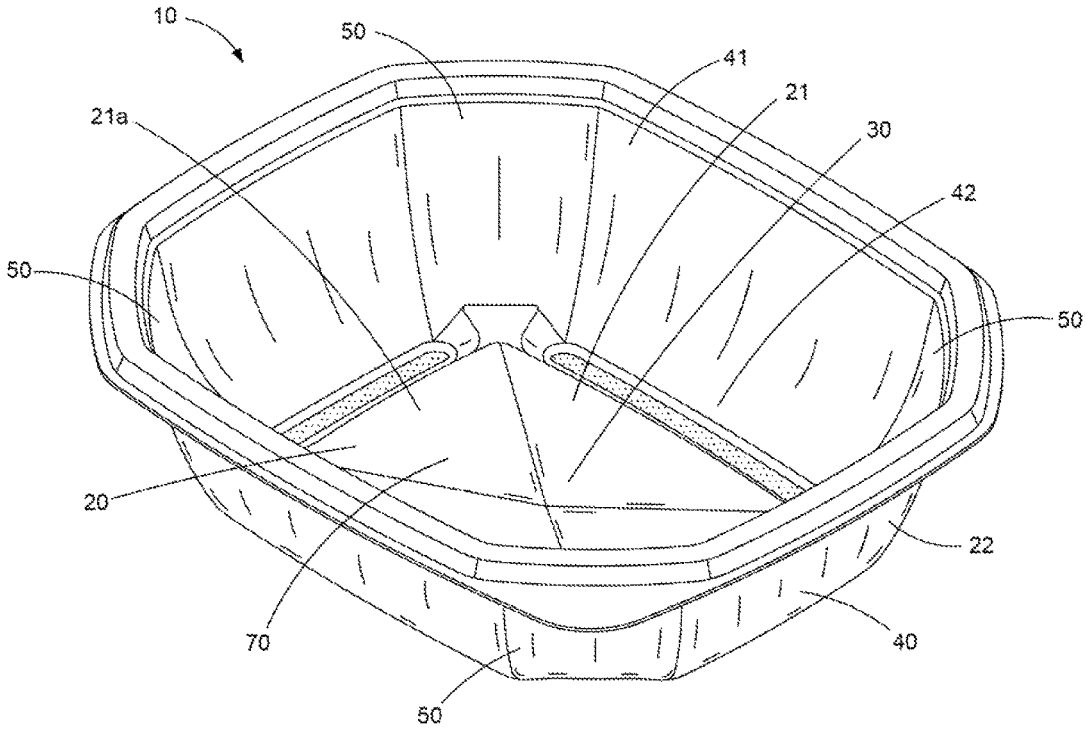
FIG. 1 illustrates an isometric view of one embodiment of a package having bowed primary and corner secondary sidewalls according to the present invention.
Figure 2:
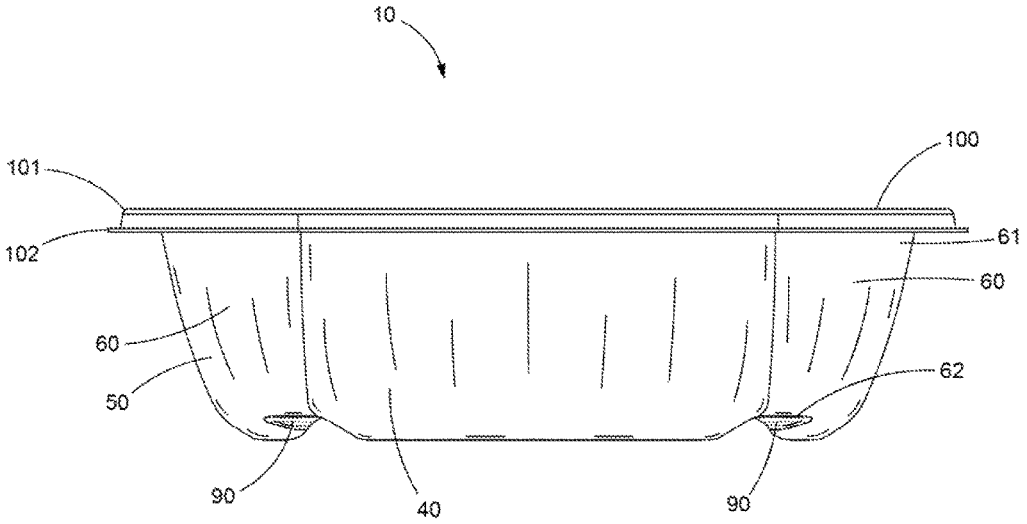
FIG. 2 illustrates a schematic side view of one embodiment of a package as shown in FIG. 1.

The present invention will be described in more detail in the following by making reference to the accompanying drawings, where identical numerals refer to identical parts, in which some of the embodiments of the present invention are illustrated.

FIGS. 1-6 illustrate preferred embodiments of a formed tray 10 of the present invention comprising a base 20 having an interior surface 21 and an exterior surface 22, a portion of the interior surface 21*a* defining a raised product contact surface 30. Tray 10 also includes a plurality of primary sidewalls 40 integrally formed with and extending upwardly and slightly outwardly from the base 20, each primary sidewall 40 has an upper portion 41 and a lower portion 42. Tray 10 further comprises a plurality of chamfered corners 50 integrally formed with and extending from the base 20. The chamfered corners 50 add rigidity and improved resistance to deformation and bending to the tray. Each corner 50 has a corner secondary sidewall 60 connecting a pair of primary sidewalls 40, each corner secondary sidewall 60 has an upper portion 61 and a lower portion 62; wherein the base 20, primary sidewalls 40 and corner secondary sidewalls 60 define a product receiving cavity 70. The product receiving cavity 70 may have a draw depth of between 1.9 cm and 7.62 cm (0.75 in and 3 in). Tray 10 still further comprises a plurality of ribs 80 integrally formed with and extending downwardly from the base 20, wherein each rib 80 is joined to a primary sidewall 40, and a plurality of channels 90 positioned between and separating adjacent ribs 80, wherein each channel 90 is substantially perpendicular to a corner secondary sidewall 60. The ribs 80 with the channels 90 created between the ribs also increase the tray's rigidity and resistance to deformation and bending.

Figure 3:
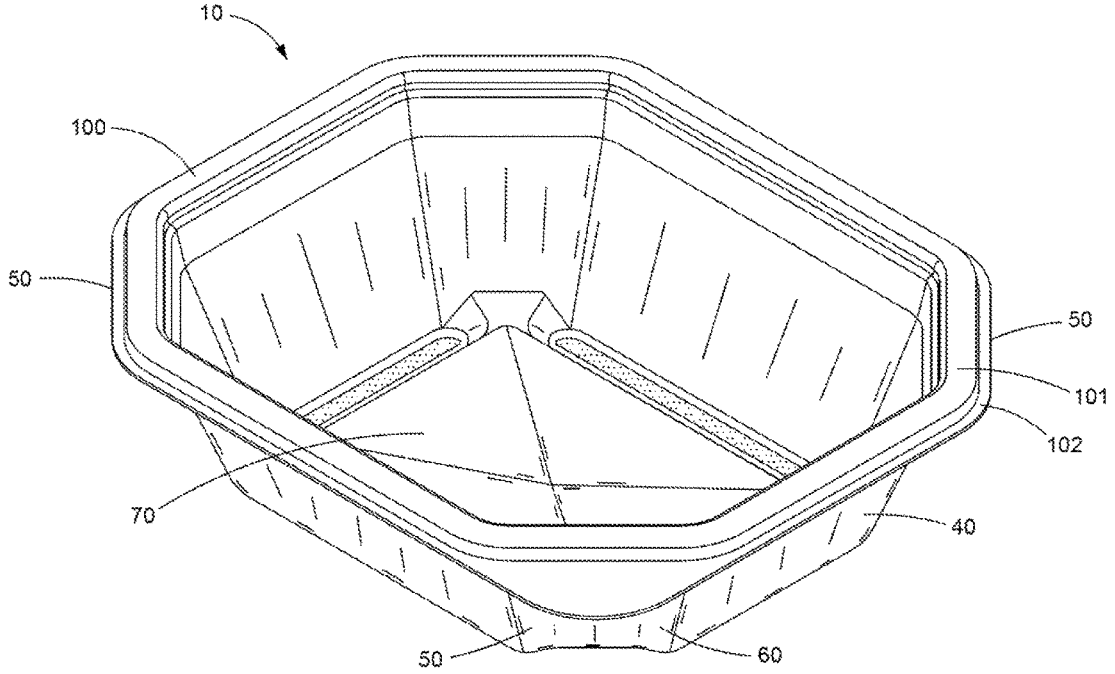
FIG. 3 illustrates an isometric view of another embodiment of a package having substantially straight primary and corner secondary sidewalls according to the present invention.
Figure 4:
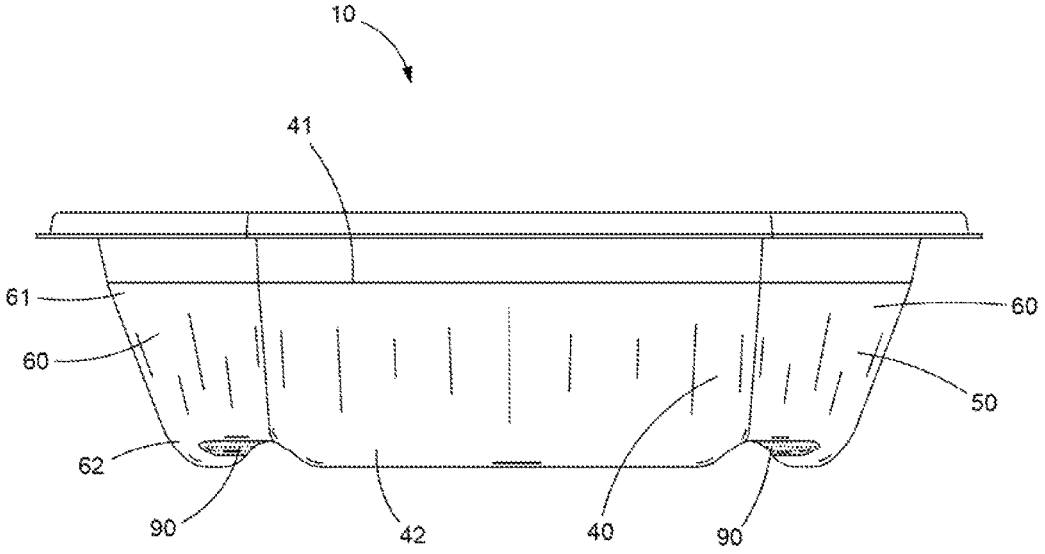
FIG. 4 illustrates a schematic side view of one embodiment of a package as shown in FIG. 3.

As illustrated in the preferred embodiments of FIGS. 1-6, tray 10 has a generally rectangular shape with at least four primary sidewalls, 40, and at least four corner secondary sidewalls 60. Tray 10 may have any number of primary sidewalls 40 and any number of corner secondary sidewalls 60. Both the height and width of the primary and corner secondary sidewalls may vary, but generally the height of the primary and corner secondary sidewalls will be identical whereas the width of the primary sidewalls may be different than the width of the corner secondary sidewalls. In one preferred embodiment, the width of the corner secondary sidewalls 60 is less than the width of primary sidewalls 40. It is preferable that both primary sidewalls 40 and corner secondary sidewalls 60 taper outwardly from the lower portions, 42 and 62, to the upper portions 41 and 61, respectively. In one preferred embodiment shown FIGS. 1-2, tray 10 includes primary sidewalls 40 and corner secondary sidewalls 60 which are arcuated or slightly bowed outward at the center of the sidewall. Alternatively, in another preferred embodiment, tray 10 may be provided with substantially straight primary sidewalls 40 and substantially straight corner secondary sidewalls 60 as illustrated in FIGS. 3 and 4. In this embodiment, the corner secondary sidewalls 60 are each chamfered and have a generally trapezoidal shape with the upper portions 61 being wider than the lower portions 62, and the two portions being substantially parallel to each other. The primary sidewalls 40 may have a generally square, rectangular or trapezoidal shape. In the embodiments illustrated in FIGS. 1-6, a generally rectangular tray is represented, that may be for instance, 176×148 mm (length× width) in size having a draw depth of 50 mm. The above size is commonly employed for solid tray but other sizes and draw depths are of course possible.

The upper portions 41 of each of the primary sidewalls 40 and the upper portions 61 of each of the corner secondary sidewalls 60 are joined together which defines a continuous rim 100 circumscribing the product receiving cavity 70. In the preferred embodiments illustrated in FIGS. 1 and 3, rim 100 comprises an upper horizontal flange 101 projecting laterally away from the primary and corner secondary sidewalls, 40 and 60, respectively. The upper horizontal flange projects outwardly generally perpendicular to the product receiving cavity 70. A preferred distance would be between approximately 2.54 mm and 12.7 mm, or between 5.08 mm and 7.62 mm. In these embodiments, rim 100 also includes a lower horizontal flange 102 projecting laterally away from the primary and corner secondary sidewalls and is disposed horizontally apart from the upper horizontal flange 101. The lower horizontal flange 102 projects outwardly generally perpendicular to the product receiving cavity 70 and parallel to the upper horizontal flange 101. A preferred distance would be between 1 mm and 7.5 mm, or between 2.5 mm and 5 mm. The lower horizontal flange 102 is off-set from upper horizontal flange 101 by a distance of between 0.1 mm and 0.8 mm, or between 0.2 mm and 0.5 mm.

Figure 5:
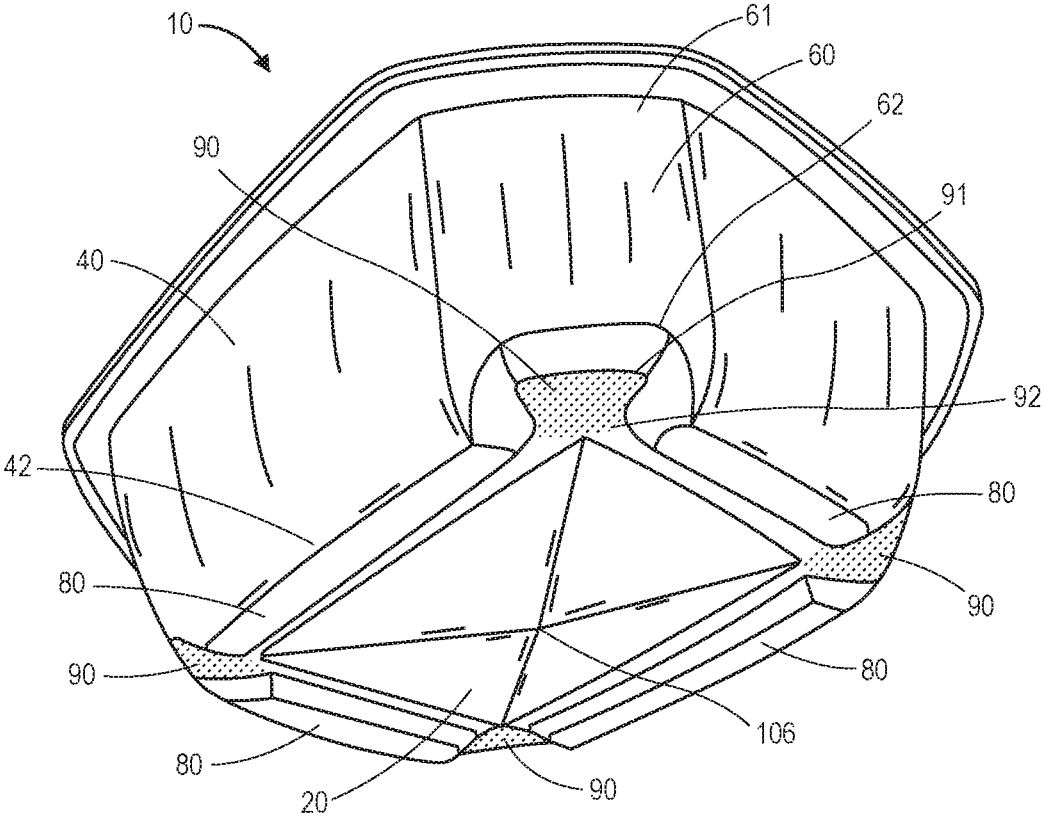
FIG. 5 illustrates another isometric view of the embodiment of a package according to the present invention as shown in FIG. 1.
Figure 6:
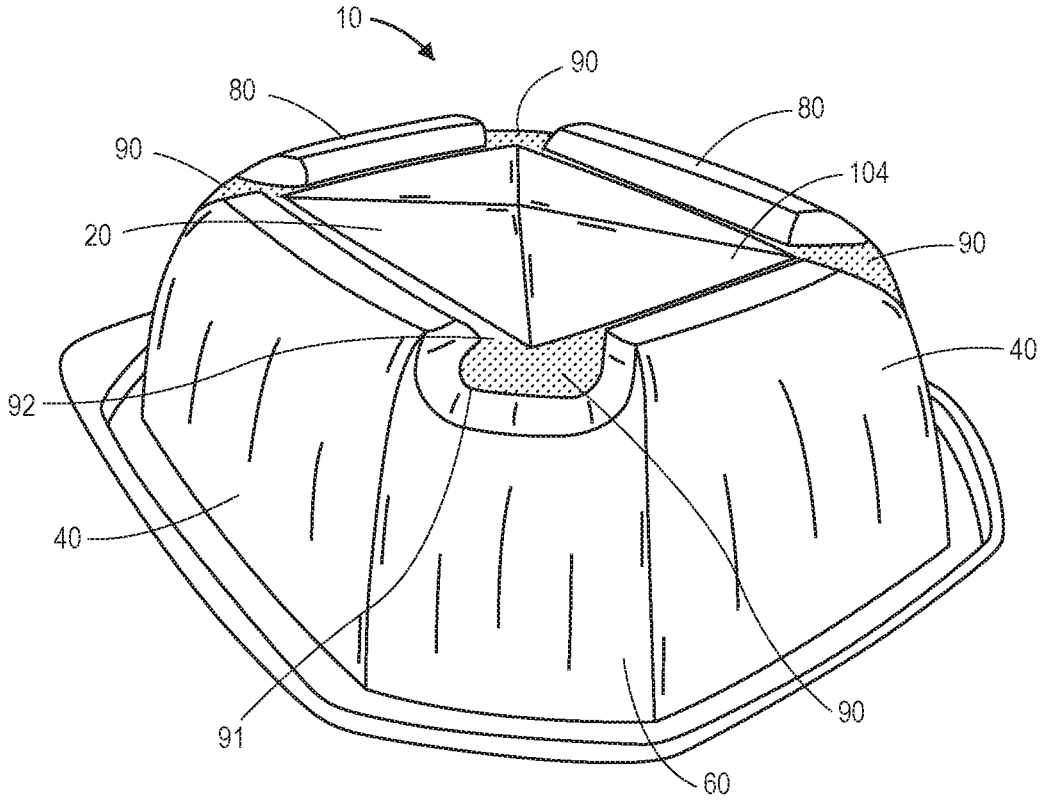
FIG. 6 illustrates another isometric view of the embodiment of a package according to the present invention as shown in FIG. 1.

Turning next to FIGS. 5 and 6, there is illustrated a preferred embodiment of a channel 90 positioned between and separating adjacent ribs 80. An important aspect of the present invention are the presence of ribs and channels which, as the inventors have discovered, greatly improves the dimensional stability of the tray when it is subjected to high temperatures and pressures during the cooking and/or pasteurization/sterilization process. Each channel is configured to be generally perpendicular to the corner secondary sidewall 60 such that the lower portion 62 of the corner secondary sidewall 60 is off-set a distance from the lower portion 42 of the primary sidewall 40. The distance between the two lower portions, 42 and 62, essentially defines the height of the ribs 80 from the base 20. Each channel is formed between two adjacent ribs 80 and may have any shape desired such as, but not limited to, square, rectangular or trapezoidal. In one preferred embodiment, each channel 90 has a generally trapezoidal shape being wider towards the exterior potion of the channel 91 than towards the interior potion of the channel 92. The width of the interior and exterior portions of the channel 91, 92, or the distances separating adjacent ribs may vary. In one non-limiting preferred embodiment, the width of interior portion of the channel, 91 is between 2 mm and 20 mm, or between 5 mm and 15 mm. The width of the exterior portion of the channel, 92, is between 5 mm and 30 mm, or between 10 mm and 25 mm. The number of ribs may vary depending upon the overall shape of the tray and the number of sidewalls. The dimensions of the ribs 80 may vary depending upon the overall shape of the tray. In one preferred embodiment illustrated in FIGS. 5 and 6, each rib 80 has a height of between 1 mm to 10 mm, or between 2 mm and 5 mm. The length of each rib may vary depending upon the length of the primary sidewalls 40. In the particular example illustrated in FIGS. 5 and 6, two opposite facing parallel ribs have a length of approximately 75 mm, and the two other two opposite facing parallel ribs have a length of approximately 45 mm. Both pairs of ribs have a width of between 2 mm and 10 mm, or between 2 mm and 8 mm.

In a preferred embodiment, the base 20 shown in FIGS. 5 and 6 as comprising a regular tessellation of congruent polygon segments 104. These congruent polygon segments 104 may be provided as any desired repeating shape and may include several different repeating shapes. In one preferred embodiment, the congruent polygon segments 104 are each a triangle. In another preferred embodiment, the tessellation comprises a single vertex 106. It is advantageous that the vertex 106 be slightly elevated relative to a flat plane drawn generally perpendicular to the primary sidewalls 40. The elevation of vertex 106 may be between 1 mm and 5 mm, or between 2 mm and 4 mm. In still another preferred embodiment, base 20 has a four-sided pyramidal topology.

The material from which the tray according to the present invention can be made is plastic, foil, paperboard or combinations thereof. Any thermoplastic material, mono- or multilayered plastic capable of being thermoformed by conventional thermoforming methods may be used. When mono-layer materials are employed, suitable thermoplastic materials that can be used are for instance, but not limited to polyesters including aromatic polyesters such as polyethylene terephthalate, crystalline polyethylene terephthalate, amorphous polyethylene terephthalate, oriented polyethylene terephthalate, polyethylene naphthalate, polybutylene terephthalate, polyethylene isophthalate, etc., polypropylene, polyamides, polystyrene, polyvinyl chloride, and combinations thereof.

When multi-layered materials are employed, they will typically comprise one or more bulk layers comprising at least one of the above materials, a layer of a sealant material, typically a polyolefin, such as an ethylene homo- or copolymers such as polyethylene, ethylene vinyl acetate copolymers, ethylene α-olefins, possibly a layer comprising a gas barrier material, such as ethylene vinyl alcohol copolymers and polyamides, possibly tie layers to improve the bond between adjacent layers, possibly other inner layers such as moisture barrier layers, easy open layers and layers containing particular additives.

In a preferred embodiment, the material of the tray or the bulk layer of the tray is polyethylene terephthalate or crystalline polyethylene terephthalate.

The thermoplastic material employed to make the tray of the present invention may be obtained as a sheet or film by extrusion, and in the case of a multilayer material, obtained by co-extrusion or conventional lamination techniques and is then converted into tray 10 by a thermoforming process. This thermoforming process can be carried out off-line, to create pre-made, separated trays that are then used in the packaging process, or in-line to create trays joined by a continuous sheet or film in which they have been formed, that are loaded with a product to be packaged and suitably closed by heat sealing a lidding film before separation of the end packages. In both cases, the thermoforming step is carried out using any conventional thermoforming machine. In particular, a thermoforming tool made of two halves is employed that includes an upper part, so called the pressure box and a lower part called the mold. The mold used has a concave, female portion with a suitable designed inside shape for the base, primary and corner secondary sidewalls, and a top edge designed for rim and upper and lower flanges according to the present invention. The heat-softened plastic sheet is drawn down over the mold by drawing a vacuum through the mold. The process may run with or without the assistance of a suitable plug. The former is commonly referred to as plug-assist thermoforming.

In case of pre-made trays, the last step which may be carried out directly in the mold or in a separate station, is the cutting of the trays from the plastic sheet and their nesting for suitable transportation.

In the case of trays made in-line with the packaging process, the plastic sheet with the trays formed therein is moved to a loading station and then to a station where the package is dosed by heat sealing of a lidding film over the tray.

The total thickness of plastic sheet is generally from about 0.5 mm (20 mil) to about 1.0 mm (40 mil), most typically from about 0.7 mm (28 mil) to about 0.8 mm (32 mil).

The above description and examples illustrate certain embodiments of the present invention and are not to be interpreted as limiting. Selection of particular embodiments, combinations thereof, modifications, and adaptations of the various embodiments, conditions and parameters normally encountered in the art will be apparent to those skilled in the art and are deemed to be within the spirit and scope of the present invention.

What is claimed:

1. A formed tray for packaging a product, the tray comprising:

a base having an interior surface and an exterior surface, a portion of the interior surface defining a raised product contact surface;

a plurality of primary sidewalls integrally formed with and extending upwardly and slightly outwardly from the base, each primary sidewall has an upper portion and a lower portion;

a plurality of chamfered corners integrally formed with and extending from the base, each corner has a corner secondary sidewall connecting a pair of primary sidewalls, each corner secondary sidewall has an upper portion and a lower portion; wherein the base, primary sidewalls and corner secondary sidewalls define a product receiving cavity;

a plurality of ribs integrally formed with and extending downwardly from the base, wherein at least one rib protrudes a distance from the base defined by an off-set distance between the lower portion of a respective corner secondary sidewall and the lower portion of a respective primary sidewall, and wherein each respective rib is further joined along a length thereof to a corresponding primary sidewall, each respective rib extending between the base and a corresponding primary sidewall, the length of each rib extending along an intersection of the base with the corresponding primary sidewall; and a plurality of channels positioned between and separating adjacent ribs, wherein each channel is substantially perpendicular to a corner secondary sidewall.

2. A tray according to claim 1, wherein the tray has at least three primary sidewalls and at least three corner secondary sidewalls.

3. A tray according to claim 1, wherein the upper portions of each of the primary sidewalls and corner secondary sidewalls are joined together thereby defining a continuous rim circumscribing the product receiving cavity.

4. A tray according to claim 3, wherein the rim comprises an upper horizontal flange projecting laterally away from the primary and corner secondary sidewalls.

5. A tray according to claim 2, wherein the rim comprises a lower horizontal flange projecting laterally away from the primary and corner secondary sidewalls.

6. A tray according to claim 5, wherein the rim comprises an upper horizontal flange projecting laterally away from the primary and corner secondary sidewalls, and the lower horizontal flange is disposed horizontally apart from the upper horizontal flange.

7. A tray according to claim 1, wherein each of the primary sidewalls and corner secondary sidewalls has a width, wherein the width of each of the corner secondary sidewalls is less than the width of each of the primary sidewalls.

8. A tray according to claim 1, wherein each of the corner secondary sidewalls has a substantially trapezoidal shape.

9. A tray according to claim 1, wherein each of the primary sidewalls has a substantially rectangular shape or a substantially trapezoidal shape.

10. A tray according to claim 1, wherein the base comprises a regular tessellation of congruent polygon segments.

11. A tray according to claim 10, wherein the polygons segments are each a triangle.

12. A tray according to claim 10, wherein the tessellation comprises a single convex vertex.

13. A tray according to claim 1, wherein the base has a four-sided pyramidal topology.

14. A tray according to claim 1, wherein the primary and corner secondary sidewalls are substantially straight.

15. A tray according to claim 1, wherein the primary and corner secondary sidewalls are outwardly bowed.

16. A tray according to claim 1, wherein the tray is suitable for heating in a microwave oven.

17. A tray according to claim 1, wherein the tray is suitable for heating in a conventional oven.

18. A tray according to claim 1, wherein the tray is dual-ovenable.

19. A tray according to claim 1, wherein the tray is formed from plastic, foil, paperboard or combinations thereof.

20. A tray according to claim 1, wherein a given channel is positioned between an end of one rib and an end of an adjacent rib.

21. A tray according to claim 1, wherein the length of each rib extends along an entire intersection of the base with the corresponding primary sidewall.

22. A tray according to claim 1, wherein at least one pair of oppositely facing ribs are parallel to one another.

* * * * *